US006363864B1

(12) United States Patent
Jamrozy et al.

(10) Patent No.: US 6,363,864 B1
(45) Date of Patent: Apr. 2, 2002

(54) LIGHTWEIGHT RAILROAD CAR FOR CARRYING STEEL COILS

(75) Inventors: Richard E. Jamrozy, New Lenox; James P. Klag, Matteson, both of IL (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/546,854

(22) Filed: Apr. 10, 2000

(51) Int. Cl.[7] ..... B61D 17/10

(52) U.S. Cl. ..... 105/418; 105/355; 105/415

(58) Field of Search ..... 105/355, 377.01, 105/377.05, 377.09, 404, 413, 416, 418; 410/47, 48, 49

(56) References Cited

U.S. PATENT DOCUMENTS

| | | | | |
|---|---|---|---|---|
| 3,291,072 A | * | 12/1966 | Cunningham | 105/367 |
| 3,353,506 A | * | 11/1967 | Snyder et al. | 105/369 |
| 3,577,933 A | * | 5/1971 | Ferris | 105/366 |
| 3,581,674 A | | 6/1971 | O'Leary | 105/367 |
| 3,776,144 A | * | 12/1973 | Eislers | 105/406 R |
| 3,910,201 A | * | 10/1975 | Kunst | 105/443 |
| 3,954,066 A | | 5/1976 | Heap | 105/416 |
| 4,493,266 A | | 1/1985 | Augustine, Jr. | 105/255 |
| 4,686,907 A | * | 8/1987 | Woollam et al. | 105/4.1 |
| 5,170,717 A | | 12/1992 | Richmond et al. | 105/377 |
| 5,191,842 A | | 3/1993 | Tinkler | 105/355 |
| 5,564,341 A | * | 10/1996 | Martin | 105/4.1 |
| 5,622,116 A | | 4/1997 | Carlton | 105/355 |
| 5,743,191 A | * | 4/1998 | Coslovi | 105/355 |

FOREIGN PATENT DOCUMENTS

DE 3911138 A1 * 10/1990 ..... B61F/1/00

* cited by examiner

*Primary Examiner*—S. Joseph Morano
*Assistant Examiner*—Frantz F. Jules
(74) *Attorney, Agent, or Firm*—Fitch, Even, Tabin & Flannery

(57) ABSTRACT

A railroad car for carrying steel coils includes a pair of spaced apart supports located inboard of the sides of the railroad car. The supports have upper angled surfaces and the supports are arranged so as to impart a trough-shape cavity for receiving bottoms of steel coils whose central axes are aligned generally parallel to the length of the railroad car. The supports carry lateral loading of the steel coil as well as draft and buff loadings. Laterally extending wings are located outboard of the supports for engaging one or more overhead covers.

20 Claims, 8 Drawing Sheets

LIGHTWEIGHT RAILROAD CAR FOR CARRYING STEEL COILS

BACKGROUND OF THE INVENTION

1. Field of the Invention

The present invention relates to a railroad car for transporting at least one cylindrical object such as a coil of rolled steel.

2. Description of the Related Art

Relatively large, heavy cylindrical objects such as coils of rolled steel have been transported on specialized railway freight cars designed for transport of these special loads. Given certain constraints for railroad car design, such as maximum width and length dimensions, the rail car must be designed to enclose a certain volume containing the particular load and the load must be arranged within the volume accorded it. The distributed loads of the goods being carried must be resolved by the car's structure so as to be ultimately borne by the railroad car trucks. At the same time, attention must be paid to reducing the weight of the railroad car itself, as much as possible.

One prior art railway car for carrying steel coils comprises a massive center sill and large, heavy side sills extending substantially the entire length of the car. Transverse cross bearers and cross ties extend outward and upward from the center sill to the side sills to define a trough. While this type of car has been generally satisfactory, there remains a need to further reduce the tare weight required to transport steel coil loads.

SUMMARY OF THE INVENTION

It is an object of the present invention to provide a railroad car for transporting steel coils and the like large, heavy cylindrical objects.

Another object of the present invention is to provide a railroad car of the above-described type having an improved intermediate sill construction which carries loads in a more efficient manner allowing a substantial reduction in the weight of the railroad car.

A further object of the present invention is to provide a railroad car of the above-described type which places support structure more directly under the load, and in particular more directly under loads comprising one or more steel coils.

These and other objects according to the principles of the present invention are provided in a railroad car for carrying steel coils in regular commercial use, including a car body elongated along a longitudinal axis for receiving the steel coils, the improvement comprising:

said car body having opposed ends with wheel trucks adjacent each end and sides extending between the ends;

a pair of draft sills adjacent each end, located below the trough;

a pair of intermediate sills extending substantially the entire length of the car body, said intermediate sills located outboard of the trough and inboard of the car body sides;

a body bolster adjacent each end of the car body, joining the intermediate sills and the draft sills; and the intermediate sills and draft sills cooperating to form a discontinuous trough for supporting the steel coils.

DETAILED DESCRIPTION OF THE PREFERRED EMBODIMENT

Figure 1:
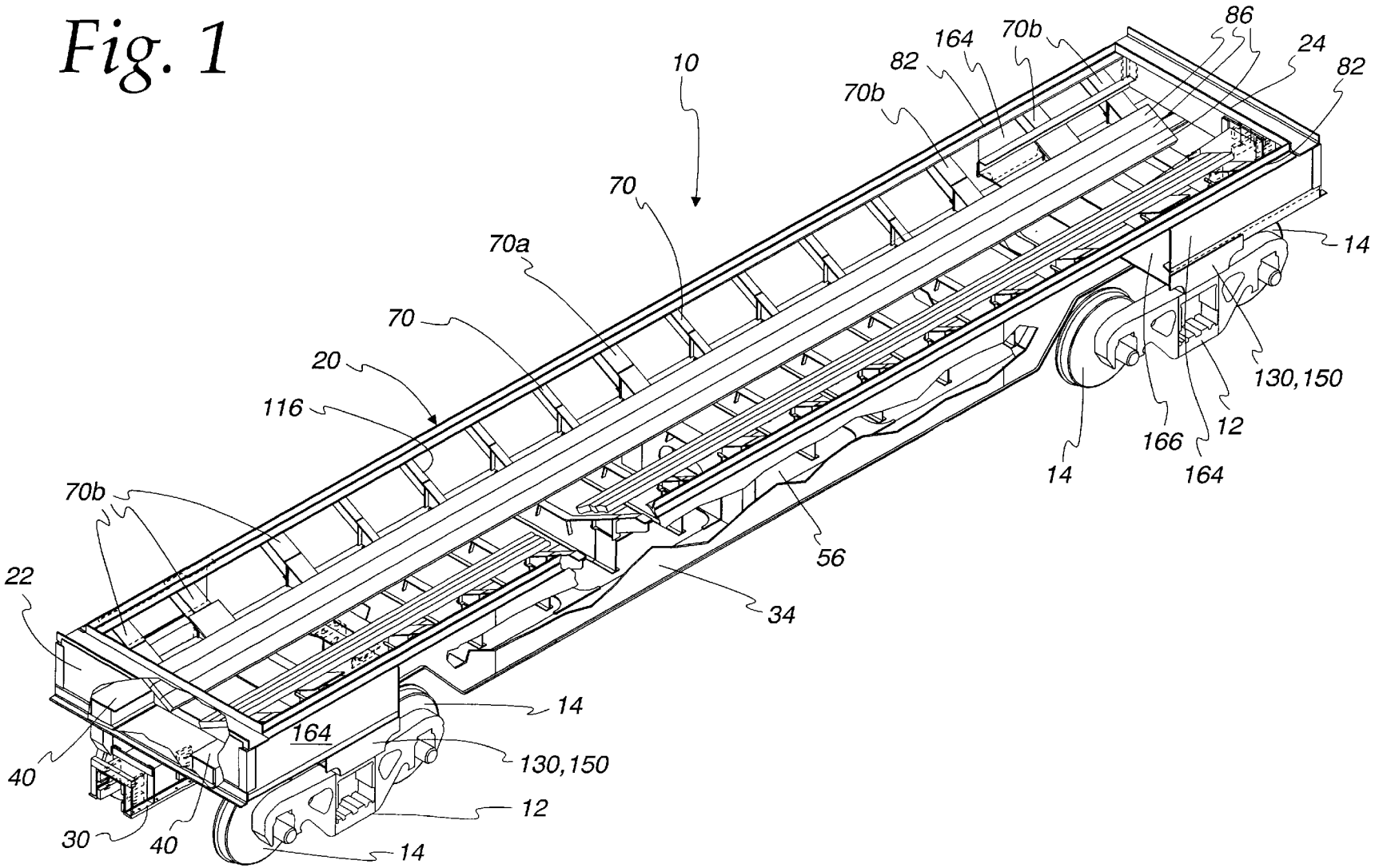
FIG. 1 is a perspective view of a railroad car in accordance with an embodiment of the present invention, shown partly broken away.
Figure 2:
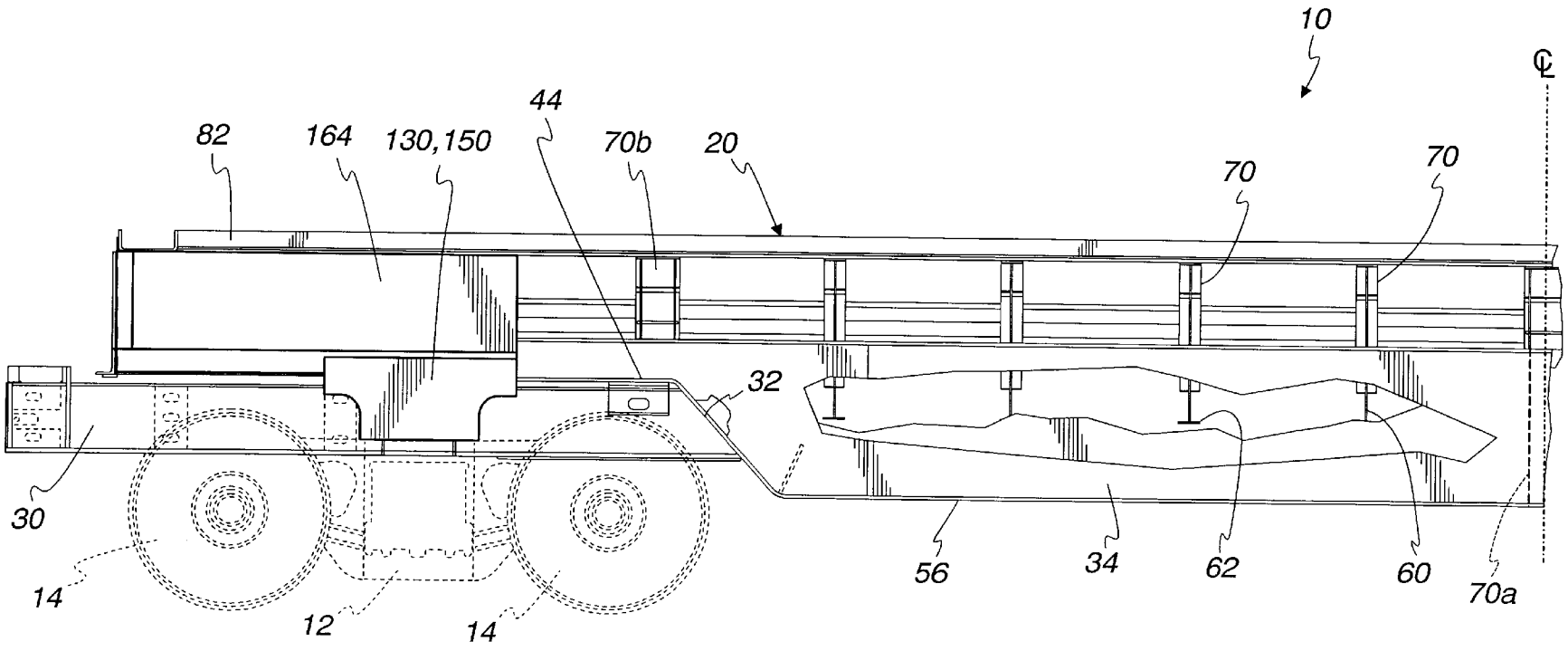
FIG. 2 is a fragmentary elevational view thereof, shown partly broken away.
Figure 3:
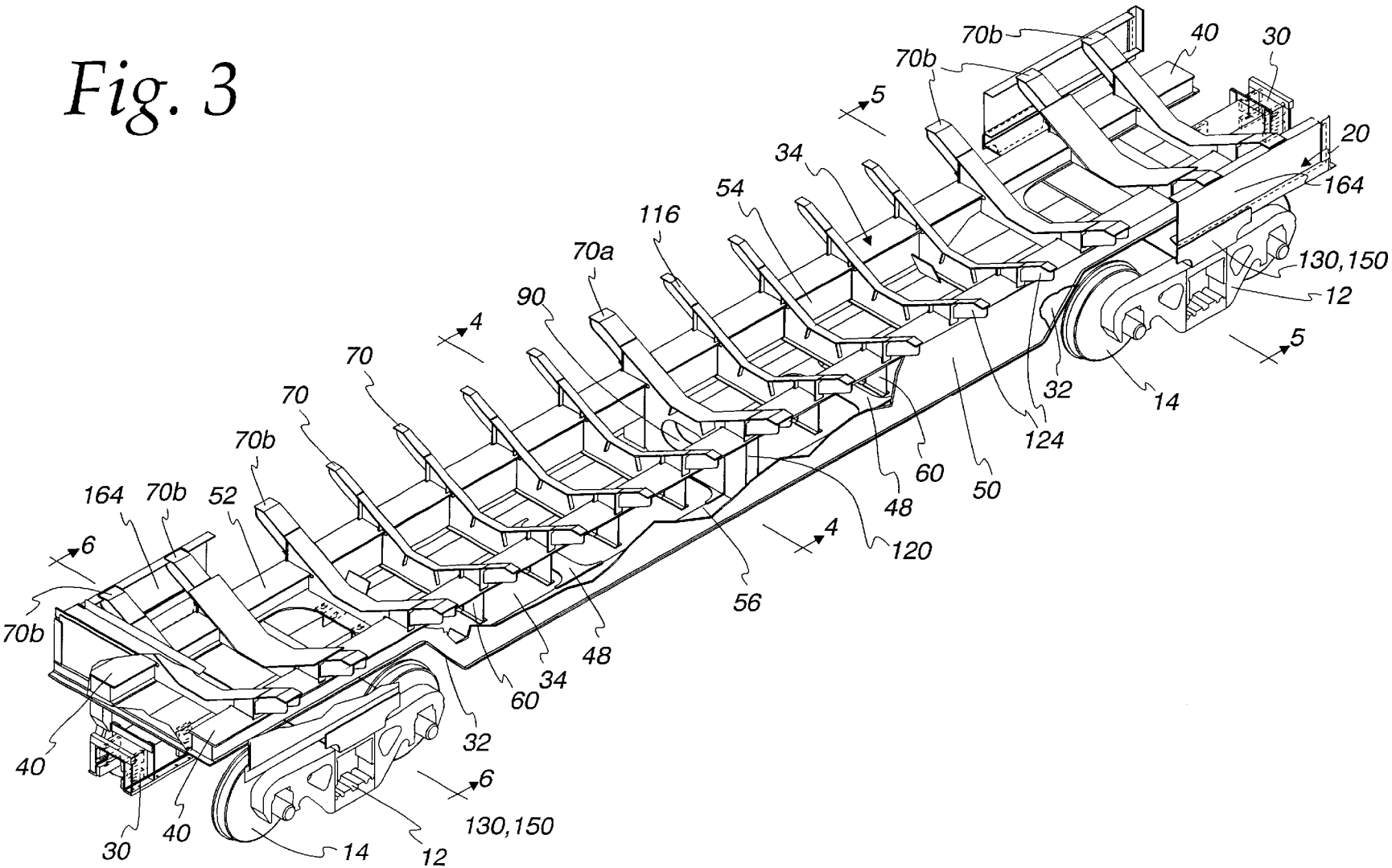
FIG. 3 is a perspective view thereof, shown partly broken away.

Referring now to the drawings, and initially to FIGS. 1–3, a railroad car 10 generally comprises first and second wheel trucks 12, each of which include pairs of wheels 14. The body for railroad car 10, generally indicated at 20, is elongated along the direction of travel and includes bulkheads 22, 24 at its first and second ends, respectively. As will be seen herein, railroad car 10 may be symmetrically constructed as a reversible car, adapted to be transported in either direction.

Figure 7:
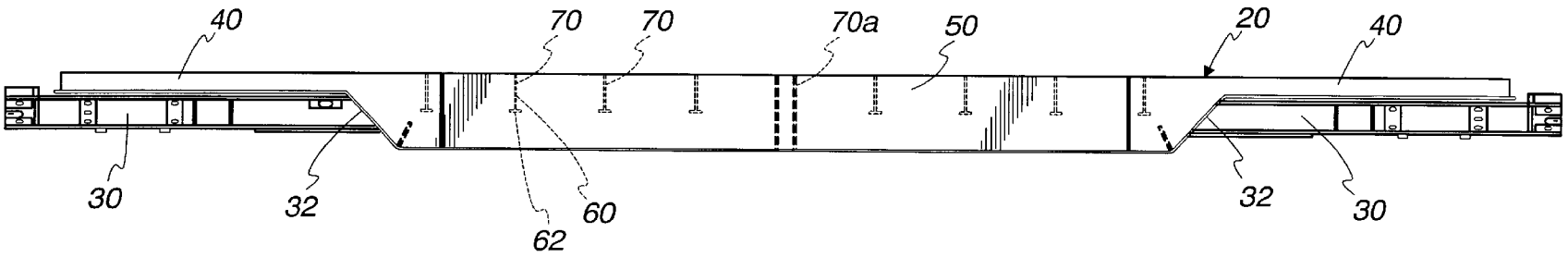
FIG. 7 is an elevational view with outer structure removed.
Figure 8:
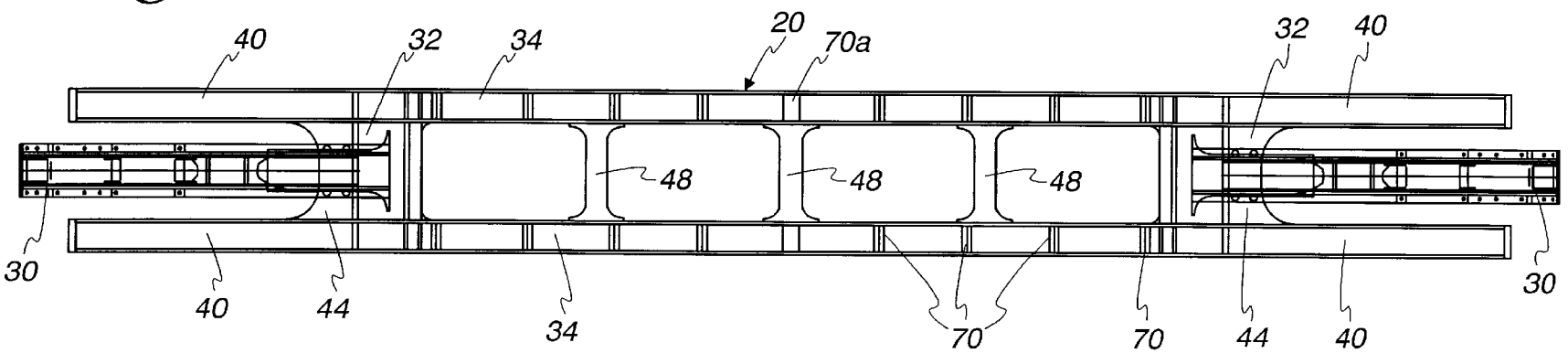
FIG. 8 is a top plan view thereof.
Figure 9:
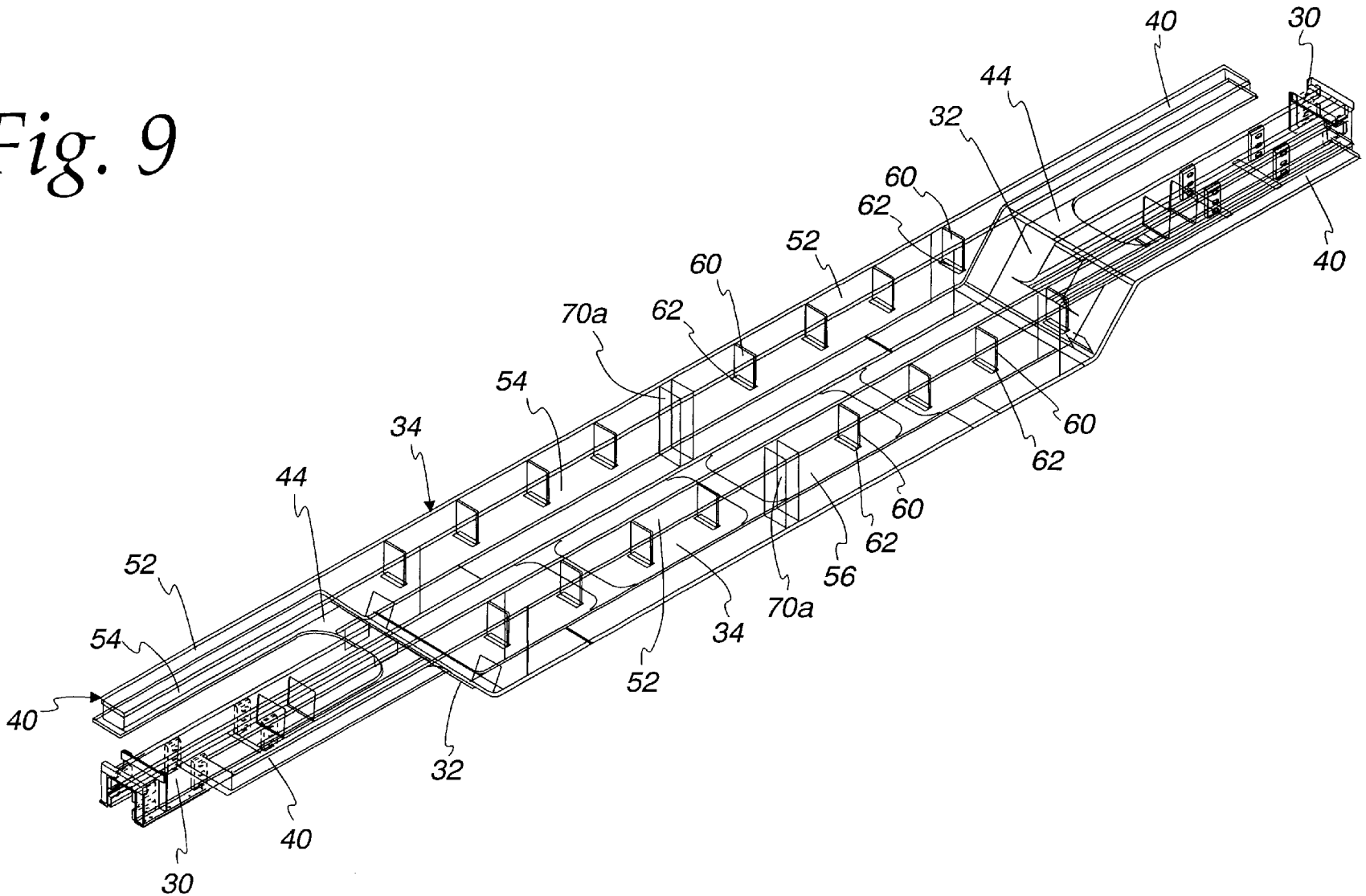
FIG. 9 is a perspective wire frame view thereof.

At each end of the car, a draft sill 30 extends past wheel trucks 12 to a floor pan 32 which spans a pair of intermediate sills 34 (see FIGS. 8 and 9). As can be seen, for example, in FIG. 7, intermediate sill extensions 50 extend between floor pan 32. Turning again to FIG. 8, full-width shear plates extend outwardly of floor pan 32, interconnecting opposed pairs of intermediate sill extensions 40 to draft sill 30. A plurality of transverse tie members 48 extend between intermediate sills 34, located adjacent the bottom of car body 20.

Referring to FIG. 3, outer walls 50 extend the length of car body 20. Outer walls 50 comprise a portion of intermediate sills 34 which, as will be seen herein, have a construction resembling a box beam. Also visible in FIG. 3 are top walls 52 and side walls 54 of intermediate sills 34. Bottom walls 56 cooperate with outer and inner walls 50. 54 to complete the box beam portion of intermediate sills 34.

With reference to FIG. 9, a plurality of internal plates 60 having a T-shaped cross section with transversely extending feet 62 are disposed within intermediate sills 34. As will be seen herein, internal plates 60 are preferably formed as part of the cross bearer members 70 (see FIG. 4).

Figure 4:
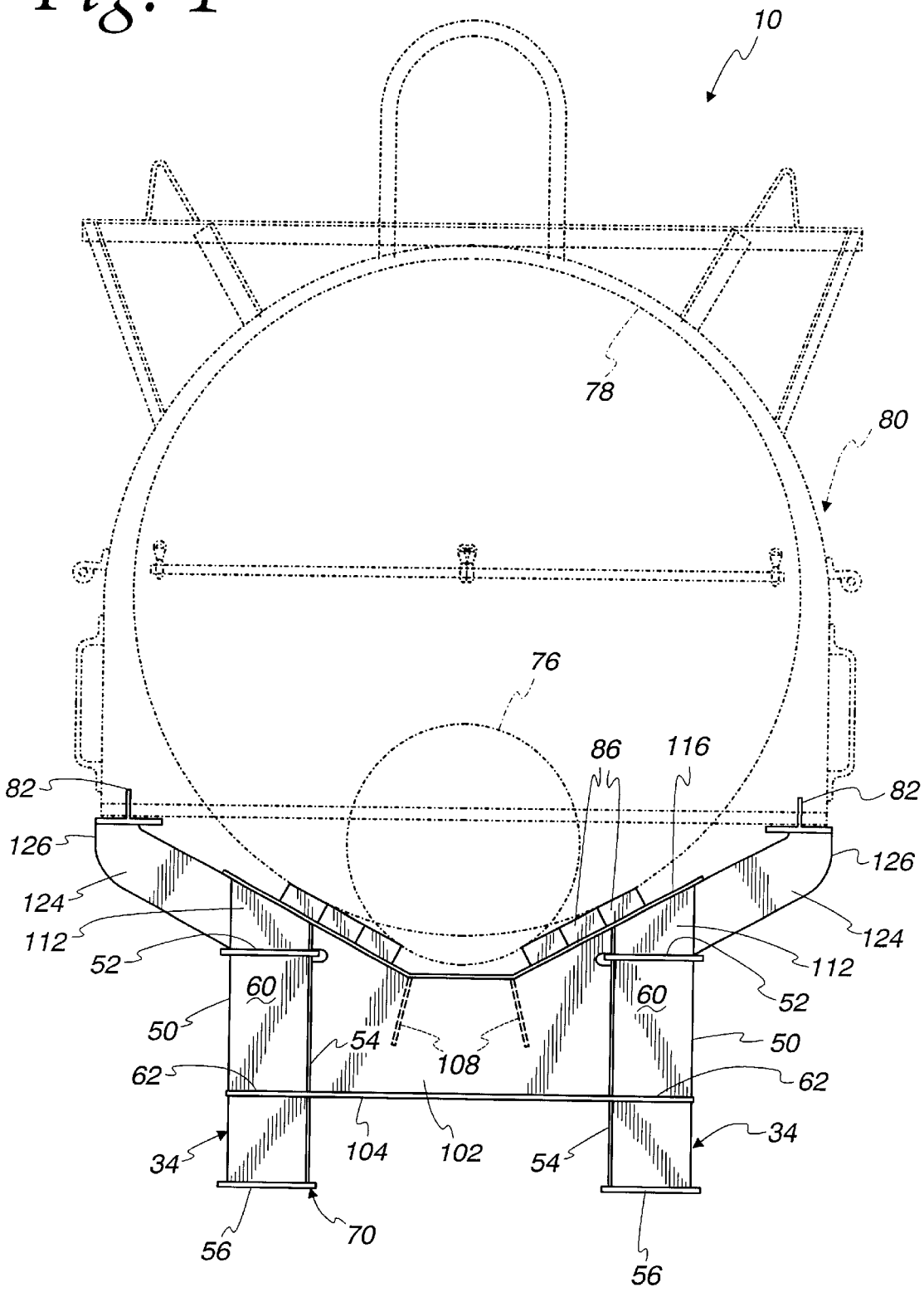
FIG. 4 is a cross-sectional view taken along the line 4—4 of FIG. 3.

As can be seen, for example, in FIG. 3, cross bearer members 70 include a central depression, which forms a discontinuous recessed trough extending the length of the car body. With reference to FIG. 4, the members 70 have depressed centers which receive cargo, preferably in the form of one or more steel coils, ranging in size between minimal size steel coil 76 and maximal size steel coil 78. The cargo carried in railroad car 10 is protected by a conventional continuous cover assembly 80. Cover assembly 80 rests on support rails 82. The steel coils rest on wooden planks 86 which cushion the steel coils during transit. Compared to other cross bearer members 70, a central member 70*a* has an increased width (i.e., as measured along the distance of travel of the railroad car). A central oval cut-out 90 is provided for weight reduction. As can be seen, for example, in FIGS. 2 and 7, members 70 extend from the top of car body 20 to a depth corresponding generally to the bottom of draft sills 30. The central cross bearer member 70 extends the full height of the car body, as shown in FIGS. 2 and 7. In a preferred embodiment, three abbreviated cross bearer members 70*b* are located at each end of the car body. As can be seen, for example, in FIG. 2, the abbreviated cross bearer members have shortened bottom portions following the shortened height of car body 20 needed to accommodate draft sills 30. As can be seen, for example, in FIG. 2, floor pan 32 is angled in an upward direction from bottom sill wall 56, being joined at its forward end to full width shear plate 44.

Turning now to FIG. 4, intermediate sills 34 include, as mentioned, outer and inner walls 50, 54 and top and bottom walls 52, 56, respectively. A web plate 102 extends between intermediate sills 34 and is T-shaped in cross section, having a transversely extending foot member 104.

With reference to FIG. 3, the central member 70*a* is substantially identical to member 70 shown in FIG. 4 except that a pair of closely spaced web plates 102 are enclosed by end walls 120 to form a box-like body, rather than a single plate box-like body construction. Cantilever wing arms 124 extend upwardly and outwardly from riser extensions 112. Wing arms 124 include outer edges 126 at the outside, or forward dimension of car 10. Wing arms 124 also include an upper horizontal surface joined to cover support rails 82.

As mentioned above, internal plates 60 are located within intermediate sills 34, and include transversely extending feet 62. In the preferred embodiment, web plate 102 and internal plates 60 comprise a continuous steel plate member, with inside walls 54 being interrupted at web plate 102 for a welded joinder thereto. In a similar manner, transversely extending foot members 62 are formed as a continuous extension of the central foot member 104 and penetrate inside wall 54 which extends downwardly to bottom wall 56.

Alternative arrangements are possible. For example, internal walls 60 can be fabricated as separate members and welded to the inner surfaces of inside sill walls 54. A separately formed web plate 102 could then be welded either to internal plates 60 or inside walls 54, or both. As shown in FIG. 4, reinforcing gussets 108 reinforce the central portion of web plate 102.

In the preferred embodiment, riser extensions 112 are installed atop the top walls 52 of the intermediate sills. Extensions 112 have upper angled surfaces to accommodate a trough-shaped pad member 116 welded to the riser members and to the top of web plate 102.

Figure 6:
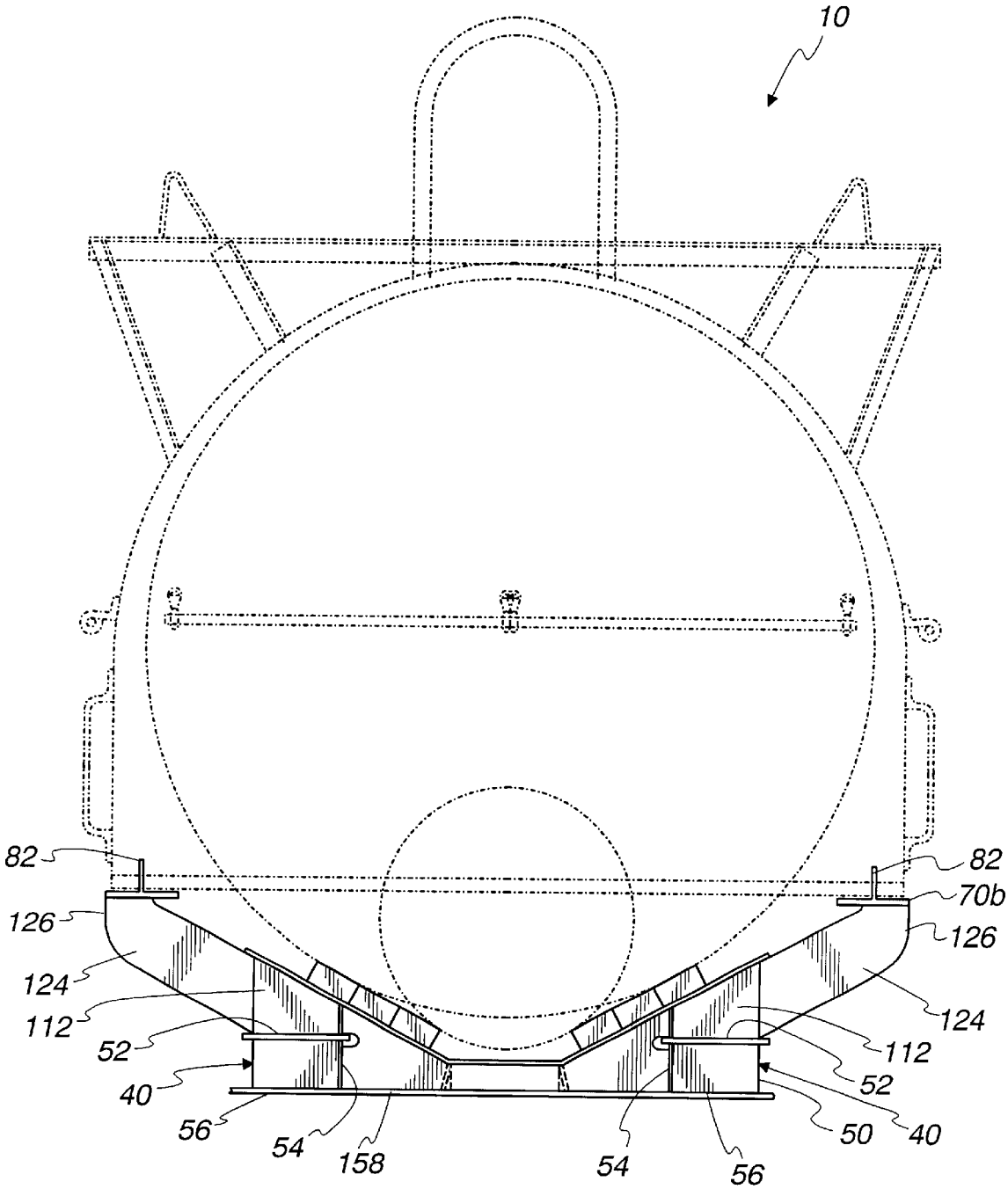
FIG. 6 is a cross-sectional view taken along the line 6—6 of FIG. 3.

Turning now to FIG. 6, a cross bearer member 70*b* is shown located at the ends of car 10. As mentioned, cross bearer member 70*b* is abbreviated or shortened in a vertical direction so as to accommodate the draft sills 30 located at the ends of car 10. Intermediate sill extensions 40 are shown, and as can be seen, have a box beam construction which includes the afore-mentioned top plate 52, an abbreviated inside wall 54, an abbreviated outside wall 50 and a bottom wall 56, preferably comprising an extension of shear plate 44. Riser extensions 112 and cantilever wing arms 124 are the same as described above with reference to FIG. 4.

Figure 5:
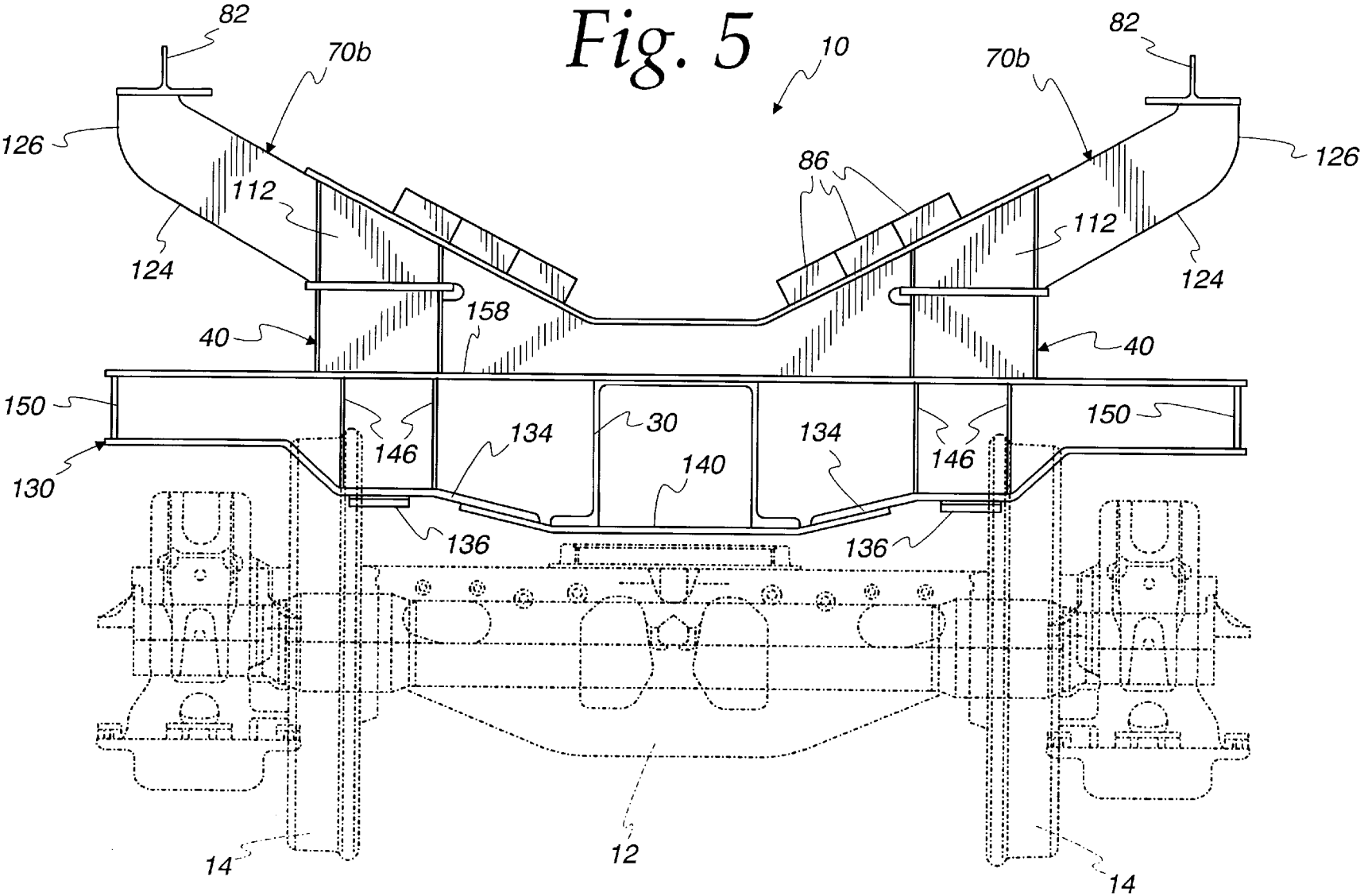
FIG. 5 is a cross-sectional view taken along the line 5—5 of FIG. 3.

With reference to FIG. 5, the abbreviated cross bearer member 70*b* is shown positioned atop a bolster generally indicated at 130. As mentioned, the outer edges 126 of cantilever wing arms 124 are located at the outside, i.e., at the full width of car 10. The improved intermediate sill construction of the present invention allows bolster 130 to be decreased in width, generally corresponding to the position of the intermediate sill extensions 40 which, as can be seen in FIG. 5, are also generally aligned with the inner faces of wheels 14.

Bolster 130 includes bottom plate members 134 which carry conventional wear plates 136. A central wall portion 140 encloses draft sill 30 and is joined at its lateral edges to bottom plates 134. Internal support plates 146 are generally aligned with side sill extensions 40 to transmit vertical loadings to draft sill 30. Outer bolster walls 150 are joined to the outer edges of bottom plate 134 and to the ends of a transverse plate 158. As shown, for example, in FIG. 1, side plates 164, 166 cooperate with bulkheads 22, 24 to enclose the outside of the bolster area.

Thus, as can be seen herein, the present invention provides an efficient lightweight support for relatively massive, compact loads such as steel coils and the like. The cooperation of the cross bearers and intermediate sills efficiently transfers draft and buff loads as well as vertical loads to the draft sills, located at the ends of railroad car 10. Further, by spacing the intermediate sills at a distance corresponding generally to the gauge of the wheel trucks, further weight reduction of the internal support members is made possible, resulting in a heretofore unattainable lightweight car body of improved load carrying efficiency.

As can be seen herein, a railroad car is provided for carrying steel coils whose central axes are aligned generally parallel to the length of the railroad car. The railroad car includes a pair of spaced apart intermediate sill supports located inboard of the sides of the railroad car. The supports have upper angled surfaces and are arranged so as to impart a trough-shape cavity for receiving bottoms of the steel coils. The supports carry lateral loading of the steel coil as well as draft and buff loadings. Laterally extending wings are located outboard of the supports for engaging one or more overhead covers.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A railroad car for carrying steel coils in regular commercial use, including a car body having outer sides and defining an elongated trough extending along a longitudinal axis of the car body for receiving the steel coils, the improvement comprising:

said car body having opposed ends with wheel trucks adjacent each end and said outer sides extending between the ends;

a draft sill adjacent each end, located below the trough;

a pair of spaced-apart substantially continuous box beam intermediate sills extending substantially the entire length of the car body, said intermediate sills located between the trough and said outer sides;

a plurality of spaced-apart cross bearer members disposed along the longitudinal axis, having first portions between said intermediate sills and second portions extending above said intermediate sills and outwardly from the first portions, beyond said outer sides;

a body bolster adjacent each end of the car body, joining the intermediate sills and the draft sills; and the intermediate sills and said cross bearer members cooperating to form a discontinuous support for supporting the steel coils and to define said trough with said cross bearer members including a central body portion disposed between the intermediate sills and cantilever wing arms extending from the central body portion, upwardly and outwardly beyond the intermediate sills to support the car sides.

2. The railroad car of claim 1 further comprising a plurality of cross bearer members extending transverse to the longitudinal axis and spaced apart along the longitudinal axis, said cross bearer members including a central body portion disposed between the intermediate sills and cantilever wing arms extending from the central body portion, outwardly beyond the intermediate sills to support the car sides.

3. The railroad car of claim 2 wherein the cantilever wing arms extend over the intermediate sills.

4. The railroad car of claim 2 wherein the cantilever wing arms define the greatest spacing of the car body sides.

5. The railroad car of claim 2 wherein a portion of the cross bearer member extends through the intermediate sills.

6. The railroad car of claim 5 wherein portions of the cross bearer member extending through the intermediate sills form vertically extending column supports, extending vertically beyond the box beams.

7. The railroad car of claim 6 wherein the vertical support columns are generally aligned with wheels carried by the wheel trucks.

8. The railroad car of claim 7 wherein said cross bearer members extend between said box beams and include generally horizontal bottom edges.

9. The railroad car of claim 2 further comprising supports for an overhead cover at the outer ends of said cantilever wing arms.

10. The railroad car of claim 1 wherein said intermediate sills have upper coil-supporting surfaces with depressed centers defining said trough.

11. The railroad car of claim 1 wherein said draft sills are formed as separate members spaced apart from one another, without a center sill construction between the draft sills.

12. A railroad car for carrying steel coils in regular commercial use, including a car body having outer sides and defining an elongated trough extending along a longitudinal axis of the car body for receiving the steel coils, the improvement comprising:

said car body having opposed ends with wheel trucks adjacent each end and said outer sides extending between the ends;

a draft sill adjacent each end, located below the trough;

a pair of spaced-apart substantially continuous box beam intermediate sills extending substantially the entire length of the car body, said intermediate sills located between the trough and said outer sides;

a plurality of spaced-apart cross bearer members disposed along the longitudinal axis, having first portions between said intermediate sills and second portions extending above said intermediate sills and outwardly from the first portions, beyond said outer sides;

a body bolster adjacent each end of the car body, joining the intermediate sills and the draft sills;

the intermediate sills and said cross bearer members cooperating to form a discontinuous support for supporting the steel coils and to define said trough;

said cross bearer members including a central body portion disposed between the intermediate sills and cantilever wing arms extending from the central body portion, upwardly and outwardly beyond the intermediate sills to support the car sides; and said box beams having midportions of predetermined height, disposed between end portions of reduced height.

13. A railroad car for carrying steel coils in regular commercial use, including a car body having outer sides and defining an elongated trough extending along a longitudinal axis of the car body for receiving the steel coils, the improvement comprising:

said car body having opposed ends with wheel trucks adjacent each end and said outer sides extending between the ends;

a draft sill adjacent each end, located below the trough;

a pair of spaced-apart substantially continuous box beam intermediate sills extending substantially the entire length of the car body, said intermediate sills located between the trough and said outer sides;

a plurality of spaced-apart cross bearer members extending transverse to the longitudinal axis and spaced apart along the longitudinal axis, having first portions between said intermediate sills and second portions extending above said intermediate sills and outwardly from the first portions, beyond said outer sides;

a body bolster adjacent each end of the car body, joining the intermediate sills and the draft sills; and the intermediate sills and said cross bearer members cooperating to form a discontinuous support for supporting the steel coils and to define said trough with said cross bearer members including a central body portion disposed between the intermediate sills and cantilever wing arms extending from the central body portion, upwardly and outwardly beyond the intermediate sills to support the car sides.

14. The railroad car of claim 13 wherein the cantilever wing arms extend over the intermediate sills.

15. The railroad car of claim 13 wherein the cantilever wing arms define the greatest spacing of the car body sides.

16. The railroad car of claim 13 wherein a portion of the cross bearer member extends through the intermediate sills.

17. The railroad car of claim 16 wherein portions of the cross bearer member extending through the intermediate sills form vertically extending column supports, extending vertically beyond the box beams.

18. The railroad car of claim 17 wherein the vertical support columns are generally aligned with wheels carried by the wheel trucks.

19. The railroad car of claim 18 wherein said cross bearer members extend between said box beams and include generally horizontal bottom edges.

20. The railroad car of claim 13 further comprising supports for an overhead cover at the outer ends of said cantilever wing arms.

* * * * *

UNITED STATES PATENT AND TRADEMARK OFFICE

CERTIFICATE OF CORRECTION

PATENT NO. : 6,363,864 B1
DATED : April 2, 2002
INVENTOR(S) : Jamrozy et al.

It is certified that error appears in the above-identified patent and that said Letters Patent is hereby corrected as shown below:

Column 5,
Lines 6-13, the following Claim 2 is substituted for Claim 2 of the issued patent:

-- 2. The railroad car of claim 1 wherein said cross bearer members include a central body portion disposed between the intermediate sills and cantilever wing arms extending from the central body portion, upwardly and outwardly beyond the intermediate sills to support the car sides. --

Signed and Sealed this

Tenth Day of August, 2004

JON W. DUDAS
*Acting Director of the United States Patent and Trademark Office*